US008643506B2

(12) United States Patent
Yamada

(10) Patent No.: US 8,643,506 B2
(45) Date of Patent: Feb. 4, 2014

(54) DRIVING ASSISTING DEVICE

(75) Inventor: Yuki Yamada, Susono (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 282 days.

(21) Appl. No.: 13/142,170

(22) PCT Filed: Dec. 26, 2008

(86) PCT No.: PCT/JP2008/073775
§ 371 (c)(1),
(2), (4) Date: Jun. 24, 2011

(87) PCT Pub. No.: WO2010/073378
PCT Pub. Date: Jul. 1, 2010

(65) Prior Publication Data

US 2011/0254701 A1 Oct. 20, 2011

(51) Int. Cl.

| | |
|---|---|
| ***G08G 1/00*** | (2006.01) |
| ***G08G 1/16*** | (2006.01) |
| ***G08G 1/09*** | (2006.01) |
| ***G08G 1/07*** | (2006.01) |
| ***G08G 1/095*** | (2006.01) |

(52) U.S. Cl.
USPC ..... 340/905; 340/901; 340/904; 340/906; 340/907

(58) Field of Classification Search
USPC ..... 340/905, 901, 904, 906, 907
See application file for complete search history.

(56) References Cited

U.S. PATENT DOCUMENTS

| | | | | |
|---|---|---|---|---|
| 4,857,921 | A * | 8/1989 | McBride et al. | 340/912 |
| 5,611,748 | A | 3/1997 | Kashiwabara | |
| 6,850,170 | B2 * | 2/2005 | Neff | 340/907 |
| 6,989,766 | B2 * | 1/2006 | Mese et al. | 340/907 |
| 7,825,825 | B2 * | 11/2010 | Park | 340/907 |
| 7,983,836 | B2 * | 7/2011 | Breed | 701/117 |

(Continued)

FOREIGN PATENT DOCUMENTS

| | | | |
|---|---|---|---|
| JP | 62-184600 | A | 8/1987 |
| JP | 03-271999 | A | 12/1991 |

(Continued)

OTHER PUBLICATIONS

Extended European Search Report issued May 29, 2012 in EP 08 87 9173.

(Continued)

*Primary Examiner* — Daniel Wu
*Assistant Examiner* — Emily C Terrell
(74) *Attorney, Agent, or Firm* — Kenyon & Kenyon LLP

(57) ABSTRACT

In a driving assisting device in which a receiver acquires the time-series traffic signal information regarding a lighting state of the traffic signal and a display and a speaker provide the lighting time information regarding a time remaining until a red signal of the traffic signal changes, the display and the speaker provide the lighting time information regarding the time remaining until the red signal of the traffic signal changes only when it is confirmed from the traffic signal information that a signal after change of the red signal permits traveling of the host vehicle. Accordingly, for example, for a light color change or the like in which an arrow lamp other than the traveling direction lights up after a red signal, a red signal waiting time is not displayed. This makes it possible to suppress factors inducing a careless driver to start driving.

3 Claims, 7 Drawing Sheets

(56) References Cited

U.S. PATENT DOCUMENTS

| | | | | |
|---|---|---|---|---|
| 2002/0070880 | A1* | 6/2002 | Dotson | 340/901 |
| 2003/0016143 | A1* | 1/2003 | Ghazarian | 340/901 |
| 2005/0128063 | A1* | 6/2005 | Isaji et al. | 340/439 |
| 2005/0134478 | A1 | 6/2005 | Mese et al. | |
| 2009/0150007 | A1* | 6/2009 | Taylor | 701/2 |
| 2010/0106413 | A1* | 4/2010 | Mudalige | 701/213 |

FOREIGN PATENT DOCUMENTS

| | | | |
|---|---|---|---|
| JP | 2004-171459 | A | 6/2004 |
| JP | 2004-258867 | A2 | 9/2004 |
| JP | 2004-310280 | A | 11/2004 |
| JP | 2005-067403 | A | 3/2005 |
| JP | 2005-247265 | A | 9/2005 |
| JP | 2005-313794 | A2 | 11/2005 |
| JP | 2005-332234 | A | 12/2005 |
| JP | 2006-048624 | A | 2/2006 |
| JP | 2006-226824 | A | 8/2006 |
| JP | 2007-270629 | A | 10/2007 |
| JP | 2007-278911 | A | 10/2007 |
| JP | 2008-097055 | A | 4/2008 |
| JP | 2008-112255 | A | 5/2008 |
| JP | 2008-276327 | A | 11/2008 |
| JP | 2008-282307 | A | 11/2008 |

OTHER PUBLICATIONS

International Preliminary Report on Patentability of PCT/JP2008/073775.

International Search Report dated Mar. 31, 2009 of PCT/JP2008/073775.

IPRP dated Apr. 12, 2011 of PCT/JP2008/073775.

* cited by examiner

DRIVING ASSISTING DEVICE

This is a 371 national phase application of PCT/JP2008/073775 filed 26 Dec. 2008, the contents of which are incorporated herein by reference.

TECHNICAL FIELD

The present invention relates to a driving assisting device and in particular, to a driving assisting device which performs driving assisting using time-series traffic signal information regarding the lighting state of a traffic signal.

BACKGROUND ART

A device which performs driving assisting using time-series traffic signal information regarding the lighting state of a traffic signal has been proposed. For example, Patent Literature 1 discloses a system in which a DSRC transmitter, which transmits the traffic signal information, is provided in a traffic signal and an in-vehicle device is mounted in a vehicle. In this system, the traffic signal information is received by a DSRC receiver of the in-vehicle device, the lighting state and the change timing of the traffic signal are acquired from the received information, and the lighting state and the change timing of the traffic signal are displayed on a display device of the in-vehicle device so that the driver can drive after recognizing a time until the lighting state of the traffic signal changes.

Patent Literature 1: Japanese Unexamined Patent Application Publication No. 2004-171459

SUMMARY OF INVENTION

Technical Problem

In the technique described above, however, if the remaining time of a red signal of a traffic signal is displayed in a single uniform way, a driver may think that the vehicle can start even though passing the traffic signal is actually prohibited. That is, in the technique described above, the driver may think that the vehicle can start toward the intersection, at which an arrow lamp other than the traveling direction is lit, after the end of a red signal waiting time.

On the other hand, in the technique described above, when displaying a red signal waiting time on the screen of the navigation system, the red signal waiting time is displayed even though the host vehicle does not stop. Accordingly, driver attention to vehicles in front may be reduced.

Here, if a complete stop is set as the start condition of display of the red signal waiting time, a driver will try to stop at the red signal as gently as possible. In this case, since the red signal waiting time is not displayed even though the speed has decreased to a slow speed at which the driver thinks that the host vehicle has substantially stopped, the driver may feel uncomfortable. That is, in the technique described above, a situation occurs in which display of the red signal waiting time by the system is not possible until the host vehicle stops completely. As a result, the time for which the red signal waiting time can be displayed may become short.

Then, if "when the speed of a host vehicle becomes equal to or smaller than a predetermined speed" is simply set as the start condition of display of the red signal waiting time, the red signal waiting time is also displayed in this case even though the host vehicle does not stop. Since this reduces driver attention to vehicles in front, the driver may not notice the approach to a vehicle in front.

The present invention has been made in view of such a situation, and it is an object of the present invention to provide a driving assisting device capable of suppressing factors inducing a careless driver to start driving. In addition, it is an object of the present invention to provide a driving assisting device capable of suppressing a situation where a red signal waiting time cannot be displayed until a host vehicle stops completely or driver attention to vehicles in front is reduced.

Solution to Problem

The present invention is a driving assisting device including an acquisition section which acquires time-series traffic signal information regarding a lighting state of a traffic signal and information providing means for providing the lighting time information regarding a time remaining until a red signal of the traffic signal changes on the basis of the traffic signal information acquired by the acquisition section. The information providing means provides the lighting time information regarding the time remaining until the red signal of the traffic signal changes only when it is confirmed from the traffic signal information that a signal after change of the red signal permits traveling of a host vehicle.

According to this configuration, in the driving assisting device in which the acquisition section acquires time-series traffic signal information regarding the lighting state of the traffic signal and the information providing means provides the lighting time information regarding the time remaining until the red signal of the traffic signal changes, the information providing means provides the lighting time information regarding the time remaining until the red signal of the traffic signal changes only when it is confirmed from the traffic signal information that a signal after change of the red signal permits traveling of the host vehicle. Accordingly, for example, for a light color change or the like in which an arrow lamp other than the traveling direction lights up after a red signal, a red signal waiting time is not displayed. This makes it possible to suppress the factors inducing a careless driver to start driving.

In addition, the present invention is a driving assisting device including an acquisition section which acquires time-series traffic signal information regarding a lighting state of a traffic signal and information providing means for providing the lighting time information regarding a time remaining until a red signal of the traffic signal changes on the basis of the traffic signal information acquired by the acquisition section. The information providing means provides the lighting time information regarding the time remaining until the red signal of the traffic signal changes only when conditions where stopping of a host vehicle is predicted are satisfied.

According to this configuration, in the driving assisting device in which the acquisition section acquires the time-series traffic signal information regarding the lighting state of the traffic signal and the information providing means provides the lighting time information regarding the time remaining until the red signal of the traffic signal changes, the information providing means provides the lighting time information regarding the time remaining until the red signal of the traffic signal changes only when the conditions where the stopping of the host vehicle is predicted are satisfied. Accordingly, it is possible to prevent the driver feeling uncomfortable because the red signal waiting time is not displayed even though the speed has decreased to a slow speed at which the driver thinks that the host vehicle has substantially stopped or to prevent a reduction in driver attention to vehicles in front which occurs because the red signal waiting time is displayed even though the host vehicle does not stop. As a result, it becomes possible to suppress a situation where the red signal waiting time cannot be displayed until the host vehicle stops completely or driver attention to vehicles in front is reduced.

It is preferable that the information providing means changes a manner of provision of the lighting time information according to the reliability of the confirmation from the traffic signal information that a signal after change of the red signal permits traveling of a host vehicle.

According to this configuration, the information providing means changes the manner of provision of the lighting time information according to the reliability of the confirmation from the traffic signal information that a signal after change of a red signal permits traveling of the host vehicle. Therefore, for example, when the reliability of a signal after change of a red signal which permits traveling of a host vehicle is low, the information providing means provides the lighting time information in the same manner as when the reliability is high so that driver misunderstanding can be prevented.

In this case, the conditions where the stopping of the host vehicle is predicted are preferably such that the speed of the host vehicle is equal to or smaller than a threshold value and a brake pedal of the host vehicle is pressed down.

According to this configuration, since "when the speed of the host vehicle is equal to or smaller than a threshold value" and "the brake pedal of the host vehicle is pressed down" are set as the conditions where the stopping of the host vehicle is predicted, it becomes possible to predict the stopping of the host vehicle reliably.

In addition, it is preferable that the conditions where the stopping of the host vehicle is predicted are changed according to the road inclination where the host vehicle is located.

According to this configuration, since the conditions where the stopping of the host vehicle is predicted are changed according to the road inclination where the host vehicle is located, it becomes possible to predict the stopping of the host vehicle reliably according to the road inclination.

Advantageous Effects of Invention

According to the driving assisting device of the present invention, it becomes possible to suppress the factors inducing a careless driver to start driving. In addition, according to the driving assisting device of the present invention, it becomes possible to suppress a situation where the red signal waiting time cannot be displayed until the host vehicle stops completely or driver attention to vehicles in front is reduced.

REFERENCE SIGNS LIST

Figure 1:
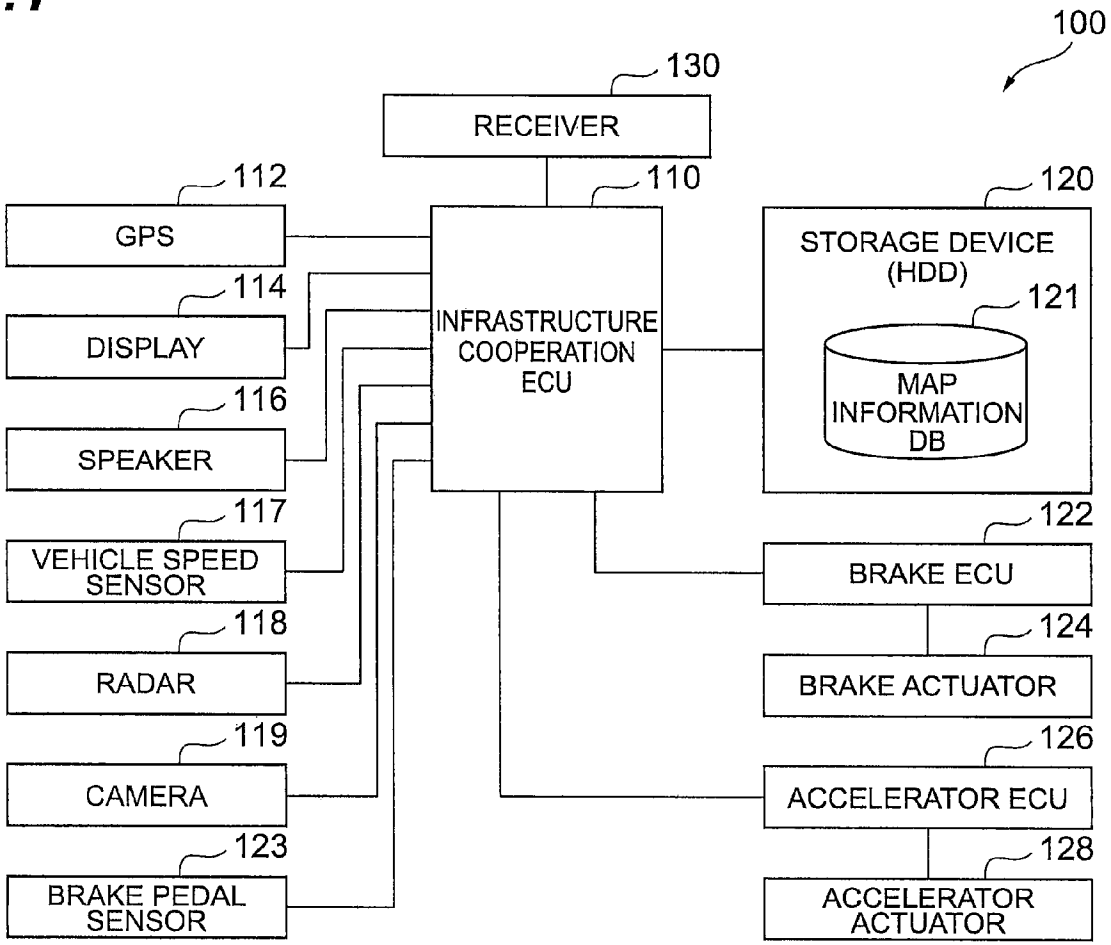
FIG. 1 is a block diagram showing the configuration of a driving assisting device related to an embodiment.

100: driving assisting device
110: infrastructure cooperation ECU
112: GPS
114: display
116: speaker
117: vehicle speed sensor
118: radar
119: camera
120: storage device (HDD)
121: map information DB
122: brake ECU
123: brake pedal sensor
124: brake actuator
126: accelerator ECU
128: accelerator actuator
130: receiver
200: screen display
210: 2D map display
220: 3D driver view display
230: service execution display icon
240: signal remaining time display icon
250: signal cycle display bar
251: acquired signal cycle time display

DESCRIPTION OF EMBODIMENTS

Hereinafter, an embodiment of a driving assisting device related to the present invention will be described with reference to the drawings. Among the drawings referred to, FIG. 1 is a block diagram showing the configuration of a driving assisting device related to an embodiment.

As shown in FIG. 1, a driving assisting device 100 of the present embodiment is configured such that a GPS 112, a display 114, a speaker 116, a vehicle speed sensor 117, a radar 118, a camera 119, a storage device (HDD) 120, a brake ECU 122, a brake pedal sensor 123, an accelerator ECU 126, and a receiver 130 are connected to an infrastructure cooperation ECU 110. The driving assisting device of the present embodiment is a device for performing driving assisting by using the time-series traffic signal information regarding the lighting state of a traffic signal that the receiver 130 has received from roadside facilities, such as a light beacon, and the navigation information according to the GPS 112 and the storage device 120, in cooperation with each other.

The GPS (Global Positioning System) 112 is for receiving signals from a plurality of GPS satellites with a GPS receiver and for measuring the position of the host vehicle from differences of each signal.

The display (information providing means) 114 is for providing the driver with the lighting time information regarding a time remaining until a red signal of a traffic signal changes and the like by screen display, as will be described later. The speaker (information providing means) 116 is for providing the driver with the lighting time information regarding a time remaining until a red signal of a traffic signal changes and the like by sound.

The vehicle speed sensor 117 is for detecting the speed of the host vehicle by detecting the rotation speed of the axle.

The radar 118 is used to acquire the speed (including the relative speed) and deceleration of a preceding vehicle in front of the host vehicle, an inter-vehicle distance between the host vehicle and the preceding vehicle, and an inter-vehicle time between the host vehicle and the preceding vehicle. The radar 118 is a sensor which irradiates an electromagnetic wave, such as a millimeter wave forwards, receives a reflected wave which returns after being reflected by the object, and detects the speed and deceleration of a preceding vehicle, an inter-vehicle distance, and an inter-vehicle time.

The camera 119 is used to acquire the speed (including the relative speed) and deceleration of a preceding vehicle, an inter-vehicle distance between the host vehicle and the preceding vehicle, and an inter-vehicle time between the host vehicle and the preceding vehicle by imaging the preceding vehicle in front of the host vehicle.

The brake pedal sensor 123 is for detecting whether or not a brake pedal is being pressed down or detecting the force on the brake pedal.

The receiver (acquisition means) 130 is specifically a light beacon receiver or a vehicle-to-vehicle communication device and is for acquiring the time-series traffic signal information regarding the lighting state of a traffic signal transmitted from a light beacon transmitter of the roadside facility or another vehicle. The lighting time information regarding a time remaining until a red signal of a traffic signal changes and the like are included in the time-series traffic signal information regarding the lighting state of the traffic signal.

The storage device (HDD: Hard Disk Drive) has a map information DB 121 in which map information is recorded, so that the infrastructure cooperation ECU can acquire not only the positioning information regarding the host vehicle acquired by the GPS 112 but also the information regarding a course along which the host vehicle is traveling, a mileage, and the like. Alternatively, the time-series traffic signal information regarding the past lighting state of a traffic signal in each location is recorded in the storage device 120.

The infrastructure cooperation ECU 110 provides the driver with the lighting time information regarding a time remaining until a red signal of a traffic signal changes and the like, through the display 114 and the speaker 116, on the basis of the time-series traffic signal information regarding the lighting state of the traffic signal that the receiver 130 received from the light beacon transmitter, the information regarding a course along which the host vehicle is traveling, a mileage, and the like acquired from the positioning information of the GPS 112 and the map information DB 121, the speed of the host vehicle acquired by the vehicle speed sensor 117, the information regarding vehicles in front acquired by the radar 118 and the camera 119, and the time-series traffic signal information regarding the past lighting state of the traffic signal in each location which is recorded in the storage device 120, and performs driving assisting by performing brake control using the brake ECU 122 and accelerator control using the accelerator ECU.

The brake ECU 122 is for performing brake control by driving a brake actuator 124 on the basis of a command from the infrastructure cooperation ECU 110. The accelerator ECU 126 is for performing brake control by driving an accelerator actuator 128 on the basis of a command from the infrastructure cooperation ECU 110.

Figure 2:
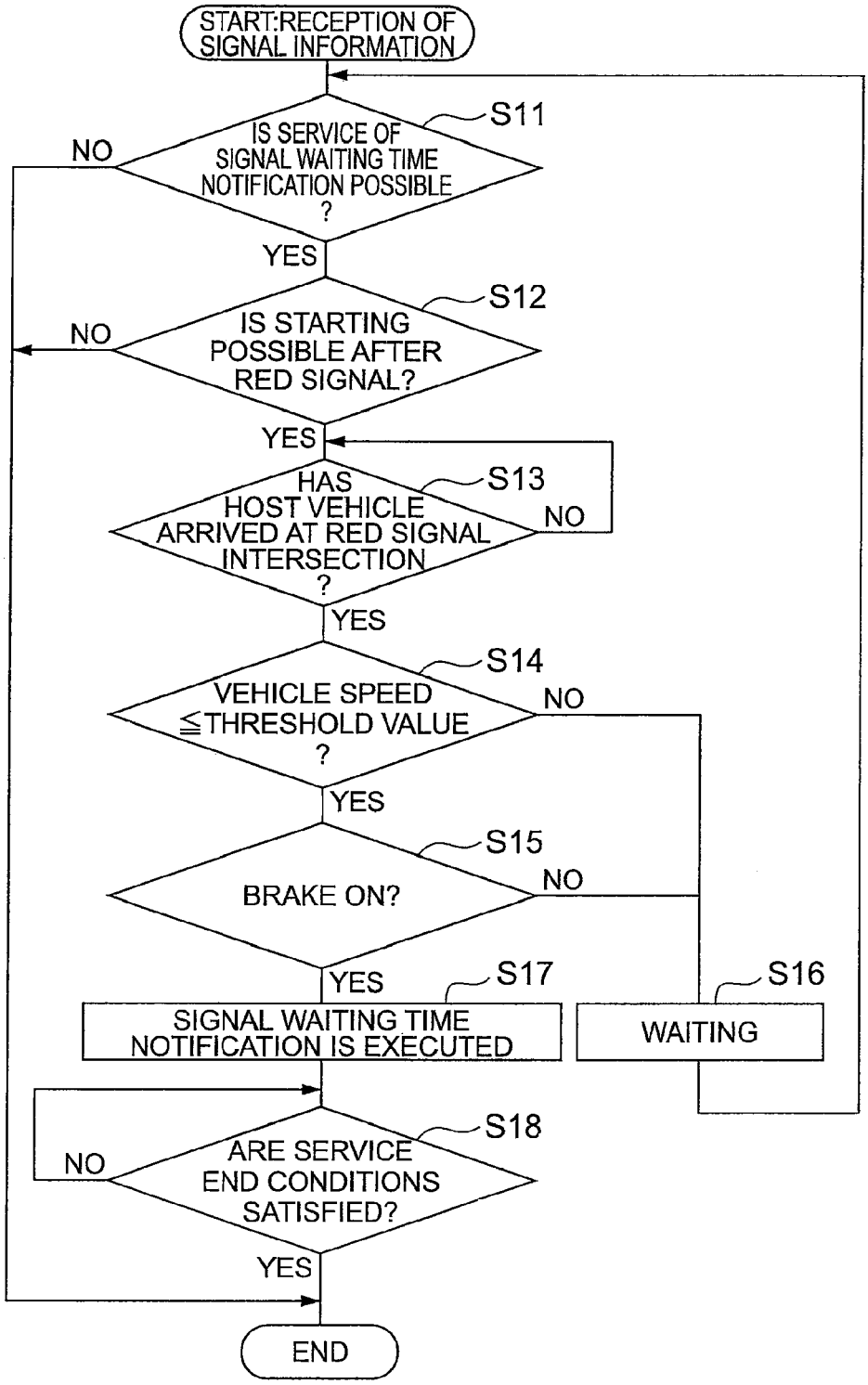
FIG. 2 is a flow chart showing an operation of the driving assisting device related to the embodiment.

Hereinafter, an operation of the driving assisting device 100 of the present embodiment will be described. FIG. 2 is a flow chart showing an operation of the driving assisting device related to the embodiment. As shown in FIG. 2, it is assumed that the infrastructure cooperation ECU 110 receives, through the receiver 130, the time-series traffic signal information regarding the lighting state of a traffic signal from a light beacon transmitter of roadside facilities or a vehicle-to-vehicle communication device or acquires time-series traffic signal information regarding the past lighting state of a traffic signal in each location which is recorded in the storage device 120.

The infrastructure cooperation ECU 110 determines as a premise whether or not a service of notification of a signal waiting time is possible using the acquired traffic signal information (S11). When a time remaining until a red signal of a traffic signal changes is shorter than a predetermined time (for example, 1 to 5 seconds) or when the time remaining until a red signal of a traffic signal changes cannot be specified, the infrastructure cooperation ECU 110 does not execute the service of notification of a signal waiting time (S11).

When it is determined by the acquired traffic signal information that the service of notification of a signal waiting time is possible (S11), the infrastructure cooperation ECU 110 determines whether or not a signal after change of a red signal permits traveling of the host vehicle (S12). The infrastructure cooperation ECU 110 specifies a target red signal from the acquired traffic signal information. If the next signal of the red signal is as follows, for example, the infrastructure cooperation ECU 110 determines that the service of notification of a signal waiting time is executable.

Figure 3:
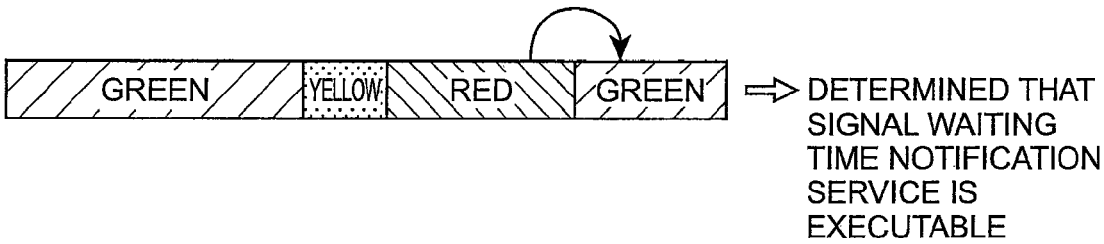
FIG. 3 is a view showing the type of a signal cycle and determination regarding whether or not a signal waiting time notification service is executable.

FIGS. 3 to 6 are views showing the types of a signal cycle and determination regarding whether or not a signal waiting time notification service is executable. As shown in FIG. 3, when the next signal of a target red signal is a green signal (including the case where the host vehicle enters during a yellow signal lighting period in order to ensure safety) or an arrow lamp of the traveling direction of the host vehicle (for example, an arrow lamp of the straight-ahead direction or an arrow lamp which permits traveling in all directions), the infrastructure cooperation ECU 110 determines whether or not the service of notification of a signal waiting time is executable.

Figure 4:
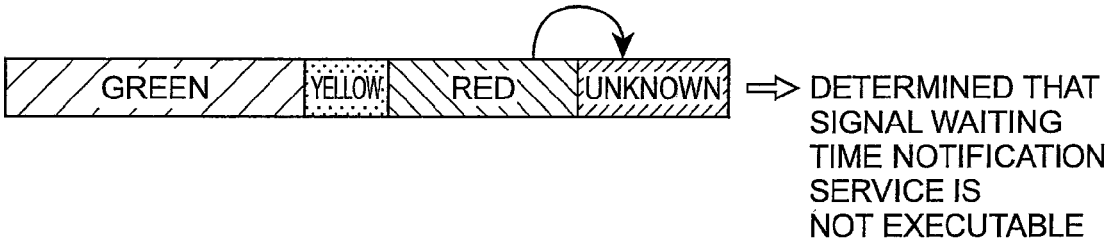
FIG. 4 is a view showing the type of a signal cycle and determination regarding whether or not a signal waiting time notification service is executable.
Figure 5:
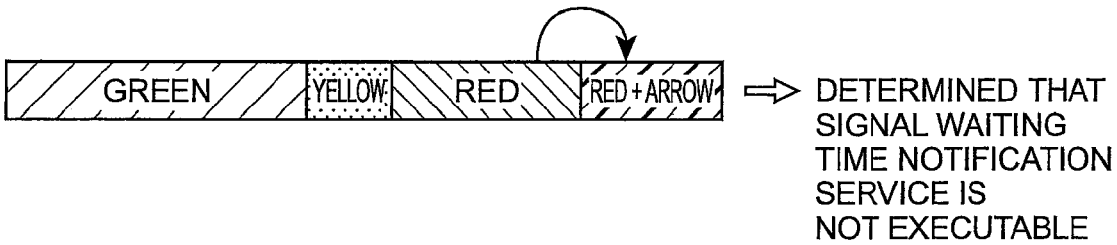
FIG. 5 is a view showing the type of a signal cycle and determination regarding whether or not a signal waiting time notification service is executable.

As shown in FIG. 4, when the next signal of a target red signal is unknown from the acquired traffic signal information, the infrastructure cooperation ECU 110 determines that the service of notification of a signal waiting time is not executable. In addition, as shown in FIG. 5, when the next signal of a target red signal is a red signal and an arrow lamp which permits only traveling other than the traveling direction of the host vehicle, the infrastructure cooperation ECU 110 determines that the service of notification of a signal waiting time is not executable.

Figure 6:
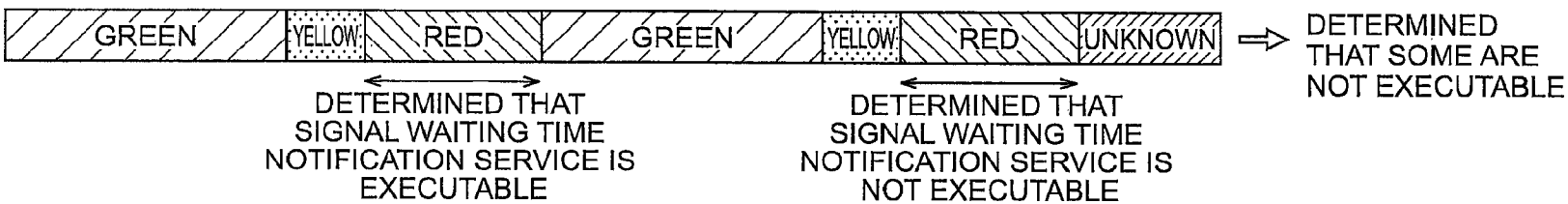
FIG. 6 is a view showing the type of a signal cycle and determination regarding whether or not a signal waiting time notification service is executable.

As shown in FIG. 6, when the lighting time of a plurality of red signals is known from the acquired traffic signal information and the next signals of some red signals are unknown, the infrastructure cooperation ECU 110 determines that the service of notification of a signal waiting time is not executable for the portion in which the next signal of the corresponding red signal is unknown.

The infrastructure cooperation ECU 110 determines whether or not the host vehicle has arrived at the intersection of a target traffic signal while the red signal is lit (S13). In this case, the determination regarding whether or not the host vehicle has arrived at the traffic signal while the red signal is lit is performed on the basis of the acquired traffic signal information, the position of the host vehicle acquired from the information of the GPS 112 and the map information DB 121, a remaining distance to the stop line, the existence of an intersection on the way, or the like.

The infrastructure cooperation ECU 110 detects whether or not the speed of the host vehicle detected by the vehicle speed sensor 117 is equal to or smaller than a threshold value (1 to 5 km/h) (S14). The infrastructure cooperation ECU 110 determines whether or not the brake pedal has been pressed down for a predetermined time (0.1 to 0.3 seconds) or more using the brake pedal sensor 123 (S15).

Except for when the speed of the host vehicle is equal to or smaller than the threshold value (S14) and the brake pedal is being pressed down (S15), the infrastructure cooperation ECU 110 waits until it changes to the state where the host vehicle speed is equal to or smaller than the threshold value and the brake pedal is pressed down (S16). On the other hand, when the speed of the host vehicle is equal to or smaller than the threshold value (S14) and the brake pedal is being pressed down (S15), the infrastructure cooperation ECU 110 displays a time remaining until the red signal of the traffic signal changes using the display 114 and the speaker 116 (S17).

Figure 7:
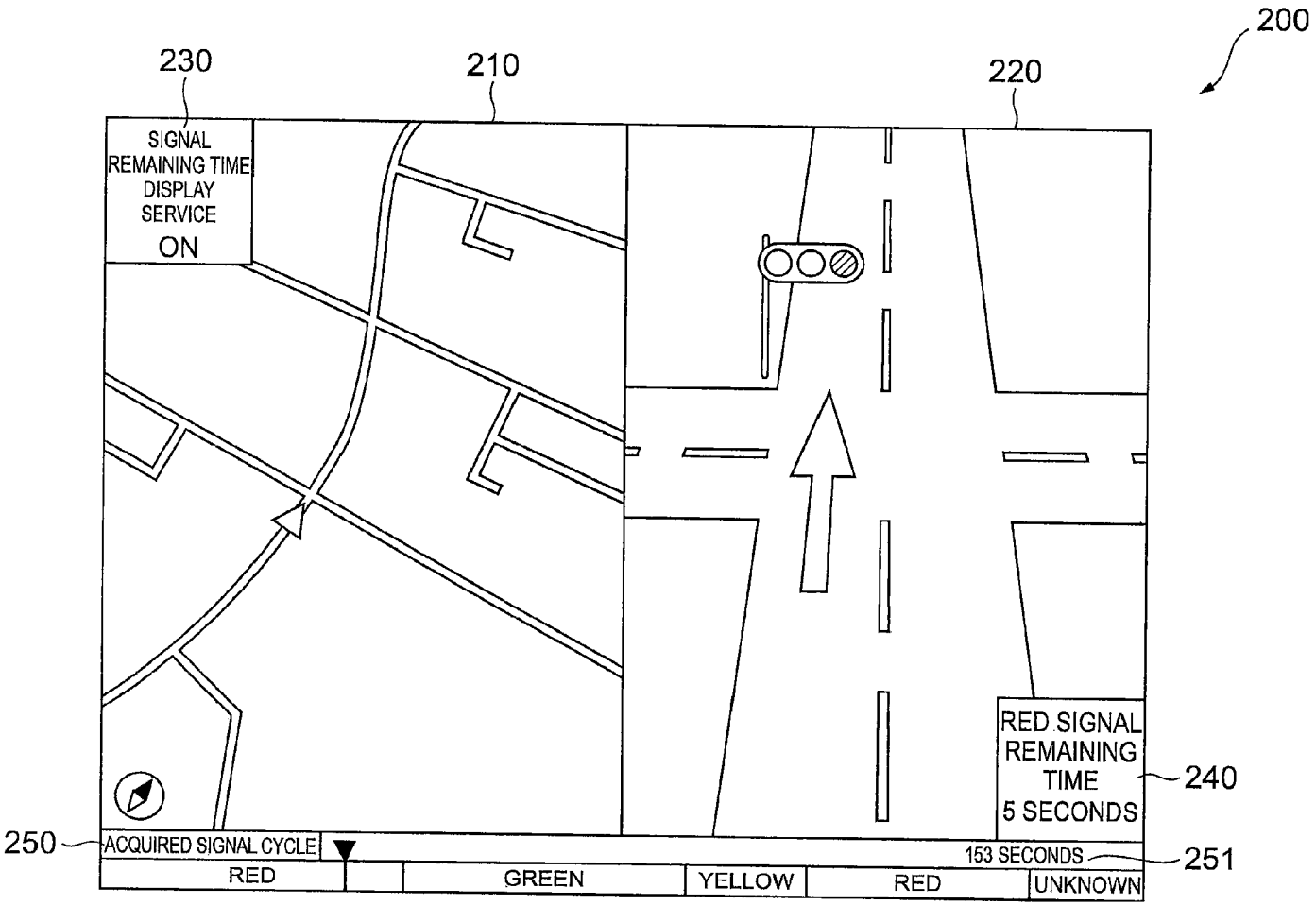
FIG. 7 is a view showing an example of a display screen when executing the signal waiting time notification service.

FIG. 7 is a view showing an example of a display screen when executing a signal waiting time notification service. As shown in FIG. 7, on a screen display 200 of the display 114, a 2D map display indicating the current position of the host vehicle is disposed on the left half screen and a 3D driver view display 220 near the intersection of a traffic signal through which the host vehicle is going to pass currently is disposed on the right half screen.

It is difficult for a driver to make a determination regarding whether or not a signal waiting time notification service is executable. Therefore, in the present embodiment, a service execution display icon 230 indicating that the signal waiting time notification service is being executed is displayed on the screen display 200 and a remaining time of a red signal is displayed at intervals of 5 seconds in a signal remaining time display icon 240 so that the driver can easily understand it. Alternatively, notification regarding whether or not the signal waiting time notification service is executable may be performed by sound in advance using the speaker 116.

Moreover, in the present embodiment, a time for which the remaining time of a red signal can be displayed is displayed on the screen display 200. For example, when the lighting time of a plurality of red signals is known from the acquired signal information and next signals of some red signals are unknown as shown in FIG. 6 described above, the traffic signal information of "not acquired" is displayed on a signal cycle display bar 250, and the time for which the remaining time of a red signal from the acquisition time of the traffic signal information can be displayed is displayed on an acquired signal cycle time display 251.

In addition, in the case where there is a possibility that the next lighting of a red signal will not permit traveling of the host vehicle, such as the case where it is difficult to predict a driver action by an arrow lamp, or in the case where the lighting time is unknown even if the next lighting of the red signal in question permits traveling of the host vehicle, the reliability that the host vehicle will travel after the end of the red signal becomes low. Accordingly, for example, when the signal waiting time is displayed until the end of a red signal, the display of the signal waiting time may be ended early before the end of the red signal. Alternatively, in the above case, the signal waiting time may not be displayed.

Alternatively, in the above case, when the remaining time of a red signal is continuously updated and displayed at intervals of several seconds, the update interval may be set to be long. For example, the remaining time of a red signal may be displayed at intervals of 10 seconds in the above case even though it is usually displayed at intervals of 5 seconds. Alternatively, only a remaining time at a point in time when the remaining time of a red signal is displayed may be displayed without updating and displaying the remaining time of a red signal.

Alternatively, the display 114 may display a signal waiting time at a point in time when the host vehicle can travel without displaying the signal waiting time at a point in time when the receiver 130 acquires the traffic signal information. In this case, since a time remaining until a red signal changes is displayed, it becomes possible to prevent a driver misunderstanding that the host vehicle can certainly pass.

On the other hand, as a method of determining the display of a remaining time of a red signal by predicting that the driver notices the presence of a vehicle in front and stops the host vehicle, there are the following methods other than the above-described method when the host vehicle speed is equal to or smaller than a predetermined value and the brake pedal is being pressed down.

That is, "when the speed of the host vehicle detected by the vehicle speed sensor 117 is equal to or smaller than a threshold value" and "when one of (1) to (4) of (1) distance from a vehicle in front is equal to or larger than a predetermined value, (2) distance to the stop line of a traffic signal is equal to or larger than a predetermined value, (3) downshifting of a transmission, and (4) accelerator is OFF (throttle opening is 0) is satisfied" may be set as conditions of display of a remaining time of a red signal.

Alternatively, "when the speed of the host vehicle detected by the vehicle speed sensor 117 is equal to or smaller than the threshold value" and "when both of (1) distance from a vehicle in front is equal to or larger than a predetermined value and (2) distance to the stop line of a traffic signal is equal to or larger than a predetermined value are satisfied" may be set as the conditions of display of a remaining time of a red signal.

In addition, the distance from a vehicle in front in the above-described condition (1) may be determined on the basis of a detection result of the laser 118 or the camera 119 or the information acquired by vehicle-to-vehicle communication using the receiver 130.

In addition, the method of determining the display of a remaining time of a red signal by predicting that the driver notices the presence of a vehicle in front and stops the host vehicle may be changed according to the road inclination. For example, the reference in predicting the stopping of a host vehicle may be set loosely at the uphill intersection, and the reference in predicting the stopping of a host vehicle may be set strictly at the downhill intersection.

Alternatively, on an uphill slope, "when the speed of a host vehicle detected by the vehicle speed sensor 117 is equal to or smaller than a threshold value and the accelerator is OFF" may be set as the condition where the remaining time of a red signal is displayed by predicting the stopping of the host vehicle. On a downhill slope, "when the speed of a host vehicle detected by the vehicle speed sensor 117 is equal to or smaller than a threshold value and the brake is ON" may be set as the condition where the remaining time of a red signal is displayed by predicting the stopping of the host vehicle. Alternatively, the threshold value of the distance from a vehicle in front or the threshold value of the distance to the stop line of a traffic signal may be changed according to the road inclination.

Returning to FIG. 2, the infrastructure cooperation ECU 110 ends the service when the service end conditions are satisfied (S18). In this case, when the vehicle speed becomes a predetermined value (1 to 5 km/h) or more, when a host vehicle moves outside the service area, when a driver selects service end setting, when the acquired traffic signal information expires, when a driver presses down an accelerator, and the like may be considered as the service end conditions.

In the present embodiment, in the driving assisting device 100 in which the receiver 130 acquires the time-series traffic signal information regarding the lighting state of a traffic signal and the display 114 and the speaker 116 provide the lighting time information regarding a time remaining until a red signal of the traffic signal changes, the display 114 and the speaker 116 provide the lighting time information regarding the time remaining until the red signal of the traffic signal changes only when it is confirmed from the traffic signal information that a signal after change of the red signal permits traveling of a host vehicle. Accordingly, for example, for a light color change or the like in which an arrow lamp other than the traveling direction lights up after a red signal, a red signal waiting time is not displayed. This makes it possible to suppress the factors inducing a careless driver to start driving.

In the driving assisting device 100 in which the receiver 130 acquires the time-series traffic signal information regarding the lighting state of a traffic signal and the display 114 and the speaker 116 provide the lighting time information regarding a time remaining until a red signal of the traffic signal changes, the display 114 and the speaker 116 provide the lighting time information regarding the time remaining until the red signal of the traffic signal changes only when the conditions where the stopping of a host vehicle is predicted are satisfied. Accordingly, it is possible to prevent the driver feeling uncomfortable because the red signal waiting time is not displayed even though the speed has decreased to a slow speed at which the driver thinks that the host vehicle has substantially stopped or to prevent a reduction in driver attention to vehicles in front which occurs because the red signal waiting time is displayed even though the host vehicle does not stop. As a result, it becomes possible to suppress a situation where the red signal waiting time cannot be displayed until the host vehicle stops completely or driver attention to vehicles in front is reduced.

In addition, according to the present embodiment, the display 114 and the speaker 116 change the manner of provision of the lighting time information according to the reliability of the confirmation from the traffic signal information that a signal after change of a red signal permits traveling of a host vehicle. Therefore, for example, when the reliability that a signal after change of a red signal is one that permits traveling of the host vehicle is low, the display 114 and the speaker 116 provide the lighting time information in the same manner as when the reliability is high so that driver misunderstanding can be prevented.

Moreover, in the present embodiment, "when the speed of the host vehicle is equal to or smaller than a threshold value and the brake pedal of the host vehicle is pressed down" is set as the condition where the stopping of the host vehicle is predicted, it becomes possible to predict the stopping of the host vehicle reliably.

In addition, according to the present embodiment, since the conditions where the stopping of the host vehicle is predicted are changed according to the road inclination where the host vehicle is located, it becomes possible to predict the stopping of the host vehicle reliably according to the road inclination.

While the embodiments of the present invention have been described, the present invention is not limited to the above-described embodiments and various modifications may also be made.

Industrial Applicability

Through the present invention, it becomes possible to suppress the factors inducing a careless driver to start driving. In addition, according to the present invention, it becomes possible to suppress a situation where the red signal waiting time cannot be displayed until a host vehicle stops completely or driver attention to vehicles in front is reduced.

The invention claimed is:

1. A driving assisting device comprising:

acquisition device for acquiring time-series traffic signal information regarding a lighting state of a traffic signal; and information providing device for providing lighting time information regarding a time remaining until a red signal of the traffic signal changes on the basis of the traffic signal information acquired by the acquisition device, wherein the information providing device provides the lighting time information regarding the time remaining until the red signal of the traffic signal changes only when:

a) it is confirmed from the traffic signal information that a signal after change of the red signal is a green signal or an arrow lamp of the traveling direction of the host vehicle, b) a speed of the host vehicle is equal to or smaller than a threshold value, and c) a brake pedal of the host vehicle is pressed down.

2. The driving assisting device according to claim 1, wherein the information providing device changes a manner of provision of the lighting time information according to reliability of confirmation from the traffic signal information that a signal after change of the red signal permits traveling of a host vehicle.

3. The driving assisting device according to claim 1, further comprising a brake pedal sensor, wherein the information providing device determines whether or not the brake pedal has been pressed down for a predetermined time or more using the brake pedal sensor.

* * * * *

UNITED STATES PATENT AND TRADEMARK OFFICE

CERTIFICATE OF CORRECTION

PATENT NO. : 8,643,506 B2
APPLICATION NO. : 13/142170
DATED : February 4, 2014
INVENTOR(S) : Yuki Yamada It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 281 days.

Signed and Sealed this
Twenty-ninth Day of September, 2015

Michelle K. Lee

Michelle K. Lee
*Director of the United States Patent and Trademark Office*